US008801813B2

(12) United States Patent
Lu et al.

(10) Patent No.: US 8,801,813 B2
(45) Date of Patent: Aug. 12, 2014

(54) HIGHLY EFFICIENT, CLEAN AND PRESSURIZED GASIFICATION APPARATUS FOR DRY POWDER OF CARBONACEOUS MATERIAL AND METHOD THEREOF

(75) Inventors: Zhengtao Lu, Beijing (CN); Mingkun Wang, Beijing (CN); Congbin Jiang, Beijing (CN); Wei Xin, Beijing (CN); Ruiheng Gao, Beijing (CN); Honghai Li, Beijing (CN)

(73) Assignee: Changzheng Engineering Co., Ltd., Beijing (CN)

( * ) Notice: Subject to any disclaimer, the term of this patent is extended or adjusted under 35 U.S.C. 154(b) by 115 days.

(21) Appl. No.: 13/519,044

(22) PCT Filed: Dec. 25, 2009

(86) PCT No.: PCT/CN2009/001558

§ 371 (c)(1), (2), (4) Date: Oct. 3, 2012

(87) PCT Pub. No.: WO2011/075878

PCT Pub. Date: Jun. 30, 2011

(65) Prior Publication Data

US 2013/0192501 A1 Aug. 1, 2013

(51) Int. Cl.
*B01J 7/00* (2006.01)

(52) U.S. Cl.
USPC ..... 48/61; 48/127.9; 48/127.1; 48/76; 48/71; 48/72; 48/73; 48/74; 48/128; 48/69; 48/67; 48/212; 48/65

(58) Field of Classification Search
USPC ..... 48/61, 127.1, 127.9, 76, 67, 71–74, 128
See application file for complete search history.

(56) References Cited

U.S. PATENT DOCUMENTS 2,818,326 A * 12/1957 Eastman et al. ..... 48/212
4,487,611 A 12/1984 Ziegler (Continued)

FOREIGN PATENT DOCUMENTS

| | | | |
|---|---|---|---|
| CN | 1039836 | A | 2/1990 |
| CN | 1417302 | A | 5/2003 |
| CN | 2700718 | Y | 5/2005 |
| CN | 101003754 | A | 7/2007 |
| CN | 101096605 | A | 1/2008 |
| EP | 0 374 323 | A1 | 6/1990 |

(Continued)

OTHER PUBLICATIONS

International Search Report for Application No. PCT/CN2009/001558, mailed Sep. 16, 2010.

(Continued)

*Primary Examiner* — Kaity Handal
(74) *Attorney, Agent, or Firm* — Nutter McClennen & Fish LLP; David J. Powsner; Derek P. Roller

(57) ABSTRACT

A gasification apparatus for solid fuel, especially an apparatus for producing syngas by pressurized gasification of coal powder, including a gasification chamber (II) and a syngas cooling and purification chamber (III). The inner wall of the gasification chamber is a water-cooling wall (4). The inner side of the water-cooled wall is evenly coated with a layer of fire-resistant material (16). There is an annular cavity between the water-cooling wall of the gasification chamber and the furnace body. A syngas quencher, a vertical pipe (22), a gas distribution device (24), a defoaming device, and a dewatering and deashing device (21) are provided in the syngas cooling and purification chamber. The apparatus has a simple structure and is easy to operate. A high temperature gasification method for dry powder of carbonaceous material comprises spraying the combustible material and oxygen into the furnace and followed by ignition.

19 Claims, 3 Drawing Sheets

(56) References Cited

U.S. PATENT DOCUMENTS

| | | | | |
|---|---|---|---|---|
| 4,494,963 | A * | 1/1985 | Reich | 48/69 |
| 4,778,483 | A | 10/1988 | Martin et al. | |
| 5,520,714 | A * | 5/1996 | Muschelknautz | 96/349 |
| 6,113,739 | A * | 9/2000 | Nilsson | 162/30.1 |
| 6,238,468 | B1 * | 5/2001 | Nilsson | 96/350 |
| 8,197,564 | B2 * | 6/2012 | Jimenez-Huyke et al. | 48/69 |

FOREIGN PATENT DOCUMENTS

| | | | |
|---|---|---|---|
| WO | 2008/065182 | A1 | 6/2008 |
| WO | 2009/095365 | A2 | 8/2009 |

OTHER PUBLICATIONS

Extended European Search Report issued Jun. 25, 2013 for Application No. 09852428.3 (11 Pages).

* cited by examiner

HIGHLY EFFICIENT, CLEAN AND PRESSURIZED GASIFICATION APPARATUS FOR DRY POWDER OF CARBONACEOUS MATERIAL AND METHOD THEREOF

TECHNICAL FIELD

The present invention relates to a pressurized gasification apparatus for dry powder of carbonaceous material, particularly to an apparatus for producing syngas by pressurized gasification of pulverized coal.

BACKGROUND ART

Gasification of the carbonaceous material (mainly coal) is one direction of the fuel utilization technologies, and its role is to convert a solid combustible material to a combustible gas or chemical feedstock for easy combustion, of which the main ingredient is a mixed gas of carbon monoxide and hydrogen. In the gasification process of the carbonaceous material, the way of entrained flow gasification has the advantages of strong processing capability of single furnace, wide adaptability for coal types, high efficiency of carbon conversion and good loading regulation and the like, which represents the development direction of gasification technology in the future. There are two main forms of entrained flow gasification area, firebrick and water-cooling wall, in which the structure of firebrick is easily damaged at high temperature and the maintenance cost is high.

The subsequent processes of the high temperature mixture generated in the reaction are mainly waste boiler process and chilling process. In CN2700718Y, a waste boiler process is used, in which the waste heat can be recovered from the coal gas, but a single waste boiler needs to be set. The waste boiler process is relatively suitable for power generation field. In WO2008/065182 A1, a chilling process is used, wherein the purpose of reducing temperature and increasing humidity is achieved by water chilling. However, due to the reason of structure arrangement, there is an increasing phenomenon of water entrainment during the gasification when high loading operation, i.e. the proportion of the liquid water in the syngas produced by the device is increased.

SUMMARY OF THE INVENTION

The purpose of the present invention is to provide a pressurized gasification apparatus for dry powder of carbonaceous material. The apparatus has a simple structure, is safe and reliable, and is easy to operate. Furthermore, the conversion rate of the carbon through the instant apparatus is high (above 99%). The present invention has overcome the problem of the deterioration of water entrainment in the gasification when the device of the prior art is in high loading operation.

The technical solution of the present invention is as follows:

In one aspect, the present invention provides a gasification apparatus for solid fuel, comprising a furnace shell system, a gasification system, and a syngas cooling and purifying system, the furnace shell system includes a furnace body of cylindrical structure and a cone-shaped disk, wherein a feeding inlet is on the top of the furnace body, a slag outlet is at the bottom of the furnace body and a syngas outlet is provided in the middle of the furnace body, the furnace body is divided into an upper furnace body and a lower furnace body by the cone-shaped disk, the upper furnace body comprises a gasification chamber which is located in the upper furnace body, and the lower furnace body comprises a syngas cooling and purifying chamber which is located in the lower furnace body, characterized in that: the gasification chamber has a water-cooling wall structure, a layer of fire-resistant material is evenly coated on the inner side of the water-cooling wall, and an annular cavity is between the water-cooling wall of gasification chamber and the furnace body; a purifying system including a syngas quencher, a vertical pipe, a gas distribution device, a defoaming device, and a dewatering and deashing device is provided in the syngas cooling and purification chamber, the syngas quencher is connected with the cone-shaped disk located at the bottom of the gasification chamber, the vertical pipe is connected with the syngas quencher by means of an outlet flange located in the middle of the bottom of the gasification chamber and is connected with the middle of the bottom of the gasification chamber, a trumpet-shaped gas distribution device is connected with the lower portion of the vertical pipe via a smooth transition, a baffle device is arranged above the gas distribution device, a defoaming device is arranged 50-800 mm above the baffle device, and a dewatering and deashing device is arranged 100-800 mm above the defoaming plate at the uppermost layer of the defoaming device.

Preferably, according to the gasification apparatus for solid fuel as mentioned above, the apparatus further comprises a flame observing system which is put into use only at the start of the device operation, the flame observing system bottom-up sequentially includes an observing tube, a cut-off valve, a transparent material layer and an industrial camera, an inlet flange for protective gas is connected with the side wall of the observing tube which is embedded in the fire-resistant material on the inner side of the inlet water-cooling wall through a furnace cover at the feeding inlet located at the top of the furnace body, an observing hole is preserved at the lower portion of the observing tube to communicate with the gasification chamber, the protective gas is flowed into the observing tube from the inlet flange for the protective gas, and the industrial camera observes the ignition conditions in the gasification chamber by means of the observing tube through transparent material layer and passes the obtained information back to a control room of the apparatus.

Preferably, according to the gasification apparatus for solid fuel as mentioned above, the apparatus further comprises a temperature monitoring system comprising several temperature detecting devices in the furnace arranged in circumferential direction at different heights of the body water-cooling wall, and the temperature detecting devices in the furnace protrude from the fire-resistant material of the water-cooling wall by 0-15 mm so as to monitor the temperature in the furnace in real-time.

Preferably, according to the gasification apparatus for solid fuel as mentioned above, the temperature monitoring system further comprises several temperature detecting devices for fire-resistant material arranged in circumferential direction at different heights, and the temperature detecting devices for fire-resistant material are 0-20 mm inwardly from the surface of the fire-resistant material of the water-cooling wall so as to monitor the temperature of the fire-resistant material in real-time.

Preferably, according to the gasification apparatus for solid fuel as mentioned above, a layer of 5-100 mm of fire-resistant material is evenly coated on the inner surface of the upper furnace body, and a layer of corrosion resisting stainless steel is overlaid on the inner surface of the lower furnace body.

Preferably, according to the gasification apparatus for solid fuel as mentioned above, the gasification chamber system consists of inlet water-cooling wall, body water-cooling wall and outlet water-cooling wall which are all in the form of spiral coil; the inlet water-cooling wall is fixedly connected with the furnace cover by means of welding, the body water-cooling wall is fixed to the support plate in the upper furnace body, the support plate in the upper furnace body is composed of two or more pre-welding members which are distributed circumferentially and evenly; the outlet water-cooling wall is fixedly connected with the outlet flange of the gasification chamber by means of welding, and the outlet flange is fixedly connected with the cone-shaped disk.

Preferably, according to the gasification apparatus for solid fuel as mentioned above, both the inner side and outer side of the inlet water-cooling wall are coated with a high temperature fire-resistant material while only the inner sides of the body water-cooling wall and the outlet water-cooling wall are coated with the high temperature fire-resistant material, the main ingredient of the high temperature fire-resistant material is silicon carbide, and the product of the high temperature fire-resistant material can be commercially purchased with the content of silicon carbide being in the range of 60-90%, preferably 75-85%.

Preferably, according to the gasification apparatus for solid fuel as mentioned above, the structure of the gas distribution device is in the form of annular plate with pores and/or a number of circular girdle with sawteeth, and a plurality of opening pores with a pore size of 10-150 mm are present on the gas distribution device.

Preferably, according to the gasification apparatus for solid fuel as mentioned above, a plurality of opening pores with a pore size of 10-150 mm are present on the baffle of the baffle device, the opening pores being staggered with the opening pores of the foregoing gas distribution device.

Preferably, according to the gasification apparatus for solid fuel as mentioned above, the defoaming device includes 2-6 layers of defoaming plates, each layer of the defoaming plates is composed of multiple annular plates which are fixed onto the support member in the lower furnace body, opening pores with a pore size of 10-150 mm are regularly arranged on the defoaming plates, and the small pores between adjacent two layers are staggered.

In another aspect, the present invention provides a high temperature and high pressure gasification method for dry powder of carbonaceous material, comprising: at the start of the apparatus operation, combustible materials, such as natural gas and diesel oil, and oxygen are sprayed into the furnace and ignited, and whether it is ignited or not is judged by the flame-observing system from a distance, if the ignition is stable, then the temperature and pressure begin to rise, and if not, it is re-ignited; after the pressure in the furnace is increased to 0.1-2.0 MPa, the dry powder of carbonaceous material and a gasification agent consisting of oxygen and steam are sprayed into the furnace, the flame-observing system is shut off when the ignition is stable, the pressure is continuously increased to a designated pressure of 1.0 MPa-10 MPa and the operation is continued; during the operation, the temperature of the furnace is judged by a temperature observing device in the furnace and the proportion of the dry powder of carbonaceous material to the gasification agent is adjusted dynamically to ensure that the gasification furnace operates at higher temperature, and the temperature of the fire-resistant material is monitored by a temperature detecting device for fire-resistant material to ensure that the temperature of the fire-resistant material is in a safe range; the generated high temperature crude syngas and the ash and slag are separated and purified through a syngas cooling and purifying system, and the ash and slag are discharged from the slag outlet and the crude syngas is transported to a subsequent process from the syngas outlet.

The purpose of the present invention can also be achieved by the following specific implementation:

A gasification apparatus for solid fuel, comprising a furnace shell system, a gasification chamber system, and a syngas cooling and purifying system, the furnace shell system includes a furnace body of cylindrical structure, a feeding inlet is on the top of the furnace body, a slag outlet is at the bottom of the furnace body and a syngas outlet is provided in the middle of the furnace body, the furnace body is divided into an upper furnace body and a lower furnace body by a cone-shaped disk, the upper furnace body is a gasification chamber, and the lower furnace body is a syngas cooling and purifying chamber, characterized in that: the gasification chamber has a water-cooling wall structure, a layer of fire-resistant material is evenly coated on the inner side of the water-cooling wall, and an annular cavity is between the water-cooling wall and the furnace body; the syngas cooling and purifying system includes a syngas quencher, a vertical pipe, a gas distribution device, a defoaming device, and a dewatering and deashing device, the vertical pipe is connected with the syngas quencher by means of an outlet flange located in the middle of the bottom of the gasification chamber and is connected with the middle of the bottom of the gasification chamber, a trumpet-shaped gas distribution device is connected with the lower portion of the vertical pipe via a smooth transition, a baffle device is arranged above the gas distribution device, and the defoaming device is arranged above the baffle device.

The gasification apparatus for solid fuel further comprises a flame observing system which is put into use only at the start of the device operation, the flame observing system bottom-up sequentially includes an observing tube, a cut-off valve, a transparent material layer and an industrial camera, an inlet flange for protective gas is connected with the side wall of the observing tube which is embedded in the fire-resistant material on the inner side of the inlet water-cooling wall through a furnace cover at the feeding inlet located at the top of the furnace body, an observing hole is preserved at lower portion of the observing tube to communicate with the gasification chamber, the protective gas is flowed into the observing tube from the inlet flange for the protective gas, and the industrial camera observes the ignition conditions in the gasification chamber by means of the observing tube through transparent material layer and passes the obtained information back to a control room of the apparatus. The transparent material layer can use at least one material selected from the group consisting of: inorganic material, such as silicon dioxide, borosilicate, aluminum silicate, potassium silicate, sodium silicate and the like; polymeric material, such as PMMA, TPX and the like; or combination thereof.

The gasification apparatus for solid fuel further comprises a temperature monitoring system comprising a temperature detecting device in the furnace, the temperature detecting device in the furnace protrudes from the fire-resistant material of the water-cooling wall by 0-15 mm so as to monitor the temperature in the furnace in real-time.

The gasification apparatus for solid fuel further comprises a temperature detecting device for fire-resistant material which is 0-20 mm inwardly from the surface of the fire-resistant material so as to monitor the temperature of the fire-resistant material in real-time.

A layer of 5-100 mm of fire-resistant material is evenly coated on the inner surface of the upper furnace body, and a layer of corrosion resisting stainless steel is overlaid on the inner surface of the lower furnace body. The gasification chamber system consists of inlet water-cooling wall, body water-cooling wall and outlet water-cooling wall which are all in the form of spiral coil; the inlet water-cooling wall is connected with the furnace cover by means of welding, the body water-cooling wall is fixed to the support plate in the upper furnace body, the support plate in the upper furnace body is composed of two or more pre-welding members which are distributed circumferentially and evenly; the outlet water-cooling wall is fixed to the outlet flange by means of welding, and the outlet flange is fixedly connected with the cone-shaped disk.

The difference of the inlet water-cooling wall from the body water-cooling wall and the outlet water-cooling wall is that both the inner side and outer side of the inlet water-cooling wall are coated with a high temperature fire-resistant material.

The structure of the gas distribution device is in the form of annular plate with pores and a number of circular girdle with sawteeth, a plurality of opening pores with a pore size of 10-150 mm are present on the gas distribution device, and the gas distribution device is fixed to the outlet in the lower end of the vertical pipe by welding.

A plurality of opening pores with a pore size of 10-150 mm are present on the baffle of the baffle device, the opening pores being staggered with the opening pores of the foregoing gas distribution plate. The baffle is fixed to the vertical pipe by the ways like welding, which is 50-500 mm above the gas distribution device.

The defoaming device includes 2-6 layers of defoaming plates, each layer of the defoaming plates is composed of multiple annular plates which are fixed onto the support member in the lower furnace body, opening pores with a pore size of 10-150 mm are regularly arranged on the defoaming plates, the vertical distance between adjacent two layers is 200-1200 mm, the small pores between adjacent two layers are staggered, and the bottom layer is 200-1000 mm above the baffle device.

At the start of the apparatus operation, combustible materials (natural gas, diesel oil etc.) and oxygen (or oxygen-enriched air) are sprayed into the furnace and ignited, and whether it is ignited or not is judged by the flame-observing system from a distance. If the ignition is stable, then the temperature and pressure begin to rise, and if not, it is re-ignited. After the pressure in the furnace is increased to 0.1-2.0 MPa, a dry powder of carbonaceous material and a gasification agent (oxygen and steam, or oxygen-enriched air and steam) are sprayed into the furnace. When the ignition is stable, the flame system is shut off. The pressure is continuously increased to a designated pressure (1.0 MPa-10 MPa) and the operation is continued. During the operation, the temperature of the furnace is judged by a temperature observing device in the furnace and the proportion of the dry powder of carbonaceous material to the gasification agent is adjusted dynamically to ensure that the gasification furnace operates at higher temperature, and the temperature of the fire-resistant material is monitored by a temperature detecting device for fire-resistant material to ensure that the temperature of the fire-resistant material is in a safe range; the generated high temperature crude syngas and the ash and slag are separated and purified through a syngas cooling and purifying system, and the ash and slag are discharged from the slag outlet and the crude syngas is transported to a subsequent process from the syngas outlet.

The apparatus provided by the present invention has a simple structure, is safe and reliable, and is easy to operate. The conversion rate of the carbon through the instant apparatus is high. Meanwhile, after the processing of the defoaming device and the dewatering and deashing device, water and ash entrainment in the syngas can be effectively decreased, which solves the problem of the deterioration of water entrainment in the gasification when the device of the prior art is in high loading operation.

The present invention is now further described with reference to the drawings and examples.

REFERENCE NUMBERS LIST

I. feeding inlet; II. gasification chamber; III. Syngas cooling and purification chamber; IV. slag outlet.

1. defoaming plate; 2. syngas quencher; 3. outlet water-cooling wall; 4. body water-cooling wall; 5. inlet water-cooling wall; 6. furnace cover; 7. industrial camera; 8. transparent material layer; 9. cut-off valve; 10. observing tube; 11. inlet flange for protective gas; 12. fire-resistant material on the inner side of the inlet water-cooling wall; 13. fire-resistant material on the outer side of inlet water-cooling wall; 14. furnace body; 15. fire-resistant material on the inner side of the upper furnace body; 16. fire-resistant material on the inner side of the water-cooling wall; 17. support plate; 18. cone-shaped disk; 19. outlet flange; 20. syngas outlet; 21. dewatering and deashing device; 22. vertical pipe; 23. baffle; 24. gas distribution plate; 25. liquid slag; 26. solid slag; 27. temperature detecting device for fire-resistant material; 28. temperature detecting device in the furnace; 29. support-member for defoaming plate.

BEST MODE FOR CARRYING OUT THE INVENTION

The structures, working principles and the preferred embodiments of the present invention are now described in detail with reference to the drawings.

Figure 1:
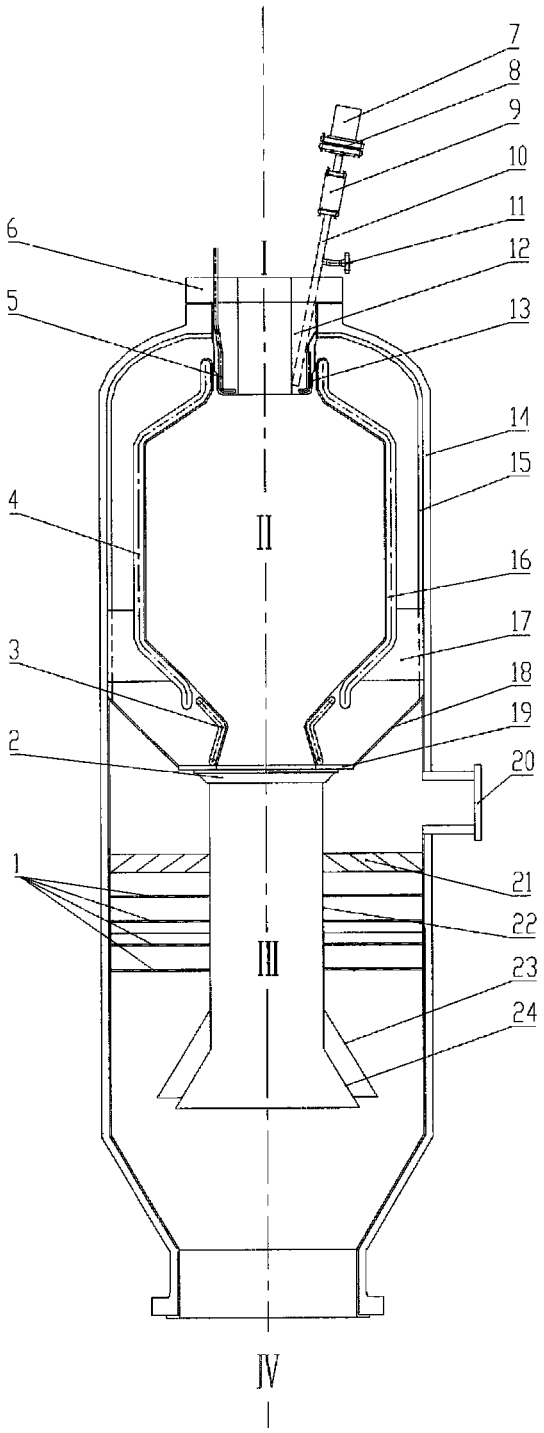
FIG. 1 is a schematic view of the structure of the present invention.
Figure 2:
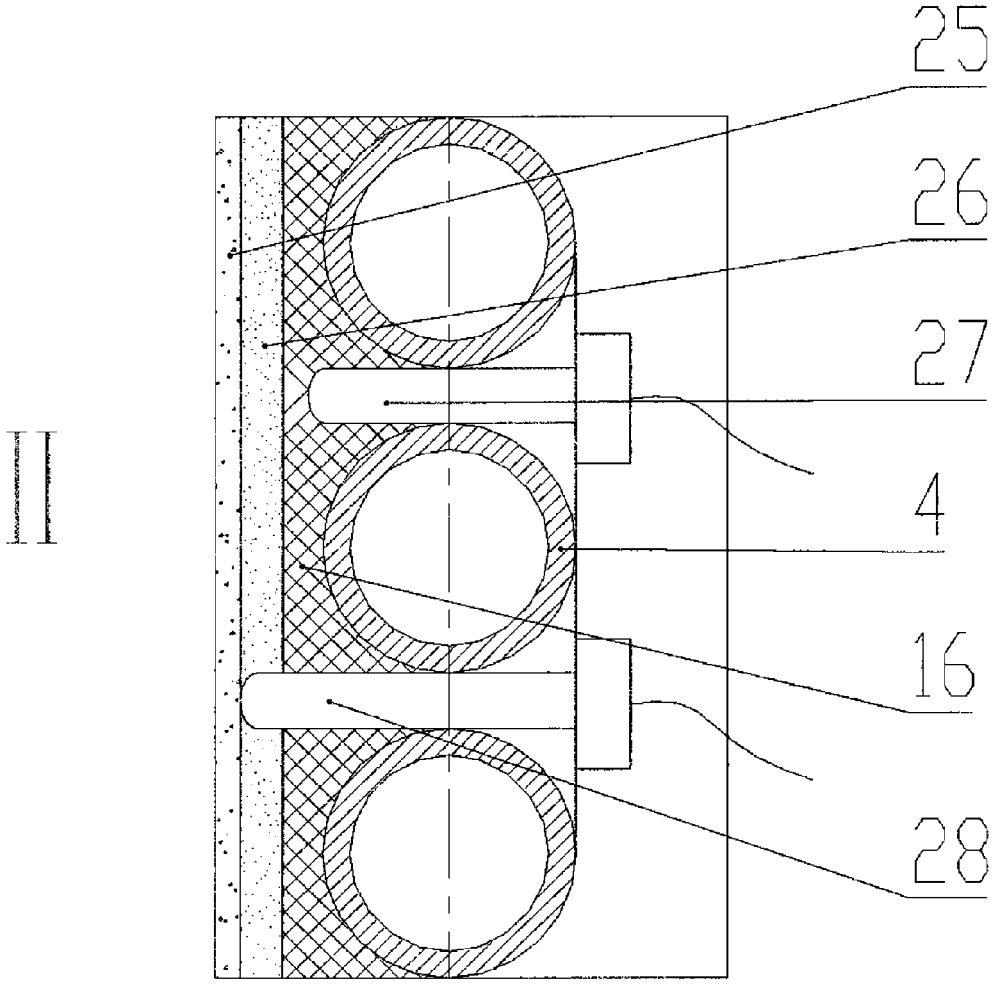
FIG. 2 is a schematic view of the temperature detecting system of the present invention, which is the sectional view of the body water-cooling wall along the A-A" direction.
Figure 3:
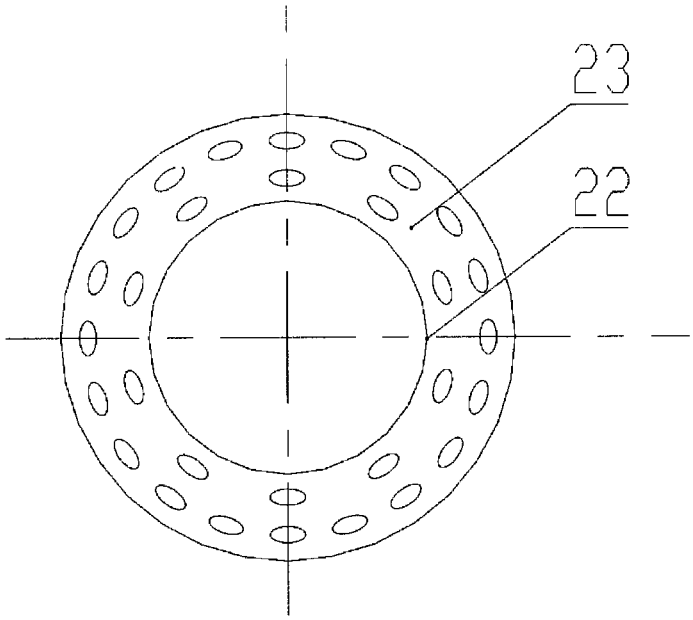
FIG. 3 is a top view of the baffle of the present invention.
Figure 4:
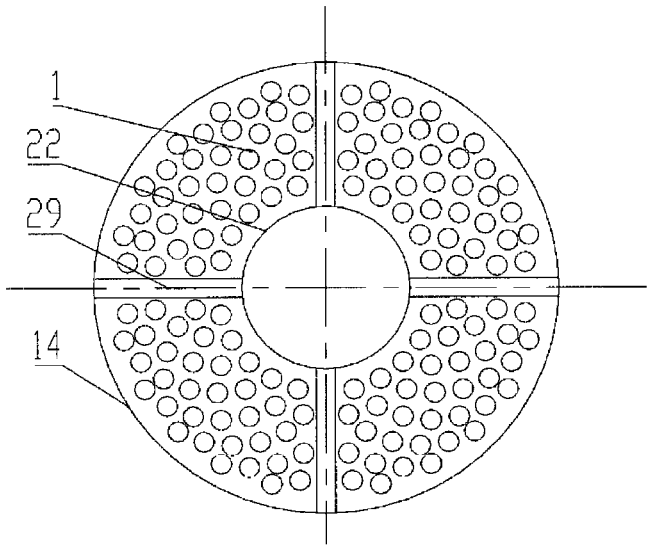
FIG. 4 is a top view of the defoaming plate of the present invention.

Refer to FIGS. 1-4, the apparatus of the present invention includes a furnace shell system, a gasification chamber system, a syngas cooling and purifying system, a flame observing system, and a temperature monitoring system.

The furnace shell system includes a furnace body 14, a furnace cover 6, and a cone-shaped disk 18. Furnace body 14 is of cylindrical structure, and furnace cover 6 is a cylindrical big flange, in the middle of which there is an circular passage. Dry powder of carbonaceous material and gasification agent (oxygen and steam, or oxygen-enriched air and steam) are sprayed into a gasification chamber II from a burner through the circular passage of the flange of the furnace cover. The furnace body is divided into two parts, i.e. an upper furnace body and a lower furnace body by cone-shaped disk 18. The upper furnace body comprises the gasification chamber II and an annular cavity II-1 around the gasification chamber II, and the lower furnace body comprises a syngas cooling and purifying chamber III. A layer of fire-resistant material is evenly coated on the inner surface of the upper furnace body with a thickness of 5-100 mm to prevent overheat damage of the furnace body caused by various reasons on one hand, and on the other hand to decrease the temperature of the furnace body and reduce heat loss. A layer of stainless steel is overlaid on the inner surface of the lower furnace body so as to prevent the furnace from corrosion caused by water slag, and also to reduce the amount of stainless steel used.

The gasification chamber system includes an inlet water-cooling wall 5, a body water-cooling wall 4, and an outlet water-cooling wall 3. The dry powder of carbonaceous material and gasification agent (oxygen and steam, or oxygen-enriched air and steam) sprayed into from the inlet nozzle are reacted quickly and incompletely under high temperature and high pressure (temperature: 1200° C.-2000° C., pressure: 1 MPa-10 MPa) in the gasification chamber to generate a high temperature syngas with the main ingredients of CO and H2, and liquid slag and high temperature fine ash with the main ingredient of inorganic salt. The reaction product flows from outlet water-cooling wall 3 into syngas cooling and purifying chamber III. The inlet water-cooling wall 5, body water-cooling wall 4, and outlet water-cooling wall 3 are all in the form of spiral coil. The inlet water-cooling wall 5 is connected with the furnace cover 6 by means of welding; the body water-cooling wall 4 is fixed to a support plate 17 in the upper furnace body, and the support plate 17 in the upper furnace body is composed of two or more pre-welding members which are distributed circumferentially and evenly; the outlet water-cooling wall 3 is fixed to the outlet flange 19 by means of welding, and the outlet flange 19 is fixedly connected with the cone-shaped disk 18. The inner space that is formed together by the inlet water-cooling wall 5, the body water-cooling wall 4 and the outlet water-cooling wall 3 is gasification chamber II. The inner surface of the water-cooling wall facing the gasification chamber is coated evenly with a layer of high temperature fire-resistant material (fire-resistant material 12 on the inner side of the inlet water-cooling wall, fire-resistant material 16 on the inner side of the water-cooling wall) with a thickness of 5-50 mm, wherein both the inner side and outer side of the inlet water-cooling wall are coated with a high temperature fire-resistant material (fire-resistant material 12 on the inner side of the inlet water-cooling wall, fire-resistant material 13 on the outer side of the inlet water-cooling wall).

The main ingredient of the fire-resistant material is silicon carbide, the product of which can be commercially purchased with the content of silicon carbide being in the range of 60-90%, preferably 75-85%.

The syngas cooling and purifying system includes a syngas quencher 2, a vertical pipe 22, a gas distribution device 24, a baffle 23, a defoaming plate 1, a dewatering and deashing device 21, and a syngas outlet 20. The high temperature mixture flowing from the outlet water-cooling wall 3 into the syngas cooling and purification chamber III is firstly subjected to quick cooling through the syngas quencher 2, such that a liquid slag 25 is changed into a solid slag 26 and lose its viscosity, meanwhile the temperature of the syngas and fine ash is reduced to prevent from burning loss of vertical pipe 22. The preliminarily cooled syngas entrained with ash and slag flows into a slag pool through the vertical pipe 22 which is covered with a water film, and mixes with the water in the slag pool, so as to continue to decrease the temperature of the syngas entrained with ash and slag on one hand, and on the other hand to remove the ash and slag therein. The lower portion of the vertical pipe 22 is connected with a trumpet-shaped gas distribution device 24 via a smooth transition, and the gas distribution device 24 can be in different forms of structure as required, for example, in the form of an annular plate with pores or a number of circular girdle with sawteeth. A plurality of opening pores with a pore size of 10-150 mm are present on the gas distribution device 24, in which a part of syngas flows upward from the opening pores, and the other part of syngas flows upward from the bottom of the gas distribution plate 24. A baffle 23 is arranged above the gas distribution plate 24, and a plurality of opening pores with a pore size of 10-150 mm are present on the baffle 23, the opening pores being staggered with the opening pores of the gas distribution plate 24, such that the flow direction of the crude syngas, especially the moving direction of the fine ash in the crude syngas flowed from the opening pores of gas distribution plate 24 is changed, thereby reinforcing the capture effect of slag water on ash, decreasing the ash in the crude syngas, and preventing the big bubbles from appearing. 2-6 layers of defoaming plate 1 is arranged above the baffle 23, each layer of the defoaming plate is composed of multiple annular plates which are fixed to a support-member for defoaming plate 29 in the lower furnace body (see FIG. 4). Opening pores with a pore size of 10-150 mm are regularly arranged on the defoaming plate 1, and the small pores between adjacent two layers are staggered, thereby the flow direction of the crude syngas is changed continuously, such that the kinetic energy for water and ash entrainment in the crude syngas is reduced, and the water and ash entrainment in the crude syngas is reduced. The syngas flowing through the defoaming plate 1 passes through the dewatering and deashing device 21, and the water entrained in the syngas is further separated. After conducting the above process, the crude syngas is transported to a subsequent procedure from the syngas outlet. The slag in the slag pool is discharged discontinuously from the slag outlet.

The flame observing system includes an observing tube 10, an inlet flange for protective gas 11, a cut-off valve 9, a transparent material layer 8, and an industrial camera 7. The observing tube 10 is embedded in the fire-resistant material on the inner side of the inlet water-cooling wall 12 through the furnace cover 6, and a hole is preserved at the lower portion of the observing tube to communicate with gasification chamber II. The protective gas is flowed into the observing tube 10 from an inlet flange for protective gas 11 to prevent the observing tube from being blocked by the high-temperature dust etc. in gasification chamber II. The industrial camera 7 observes the ignition conditions in gasification chamber II by means of the observing tube 10 through the transparent material layer 8, and passes the obtained information back to a control room of the apparatus where the ignition conditions can be observed by the operator.

The temperature monitoring system includes a temperature detecting device 28 in the furnace, and a temperature detecting device 27 for fire-resistant material. The head of temperature detecting device 28 in the furnace protrudes from the fire-resistant material 16 by 0-15 mm, and a layer of the temperature detecting device 28 in the furnace is arranged every other 800-1800 mm of height downward from the top of the vertical part of the body water-cooling wall, wherein 2-6 of the temperature detecting devices 28 in the furnace are arranged on each layer in the circumferential direction thereof, and the temperature detecting devices 28 in the furnace get the distribution situation of the temperature field in the furnace through obtaining the temperature at the transition position of the liquid slag and solid slag of each detecting site during the gasification operation. The reading of the temperature detecting device 28 in the furnace will ascend quickly when the temperature in the furnace is too high, then the ratio of 0/C of the material should be adjusted down. If the adjustment is not in time, the temperature detected by the temperature detecting device 27 for fire-resistant material will exceed the safe temperature, then the gasification furnace should be shut off decisively so as to avoid damage of gasification furnace and ensure the safety of the equipment. The temperature detecting device 27 for fire-resistant material is 0-20 mm inwardly from the surface of the fire-resistant material 16, and also a layer of the temperature detecting device 27 for fire-resistant material is arranged every other 800-1800 mm of height downward from the top of the vertical part of the body water-cooling wall, wherein 2-6 of the temperature detecting devices 27 in the furnace are arranged on each layer in the circumferential direction thereof. The temperature detecting device 27 for fire-resistant material gets the distribution situation of the temperature field of the fire-resistant material in the furnace through real time monitoring of the temperature of the fire-resistant material at each monitoring site. The operational state of the apparatus can be known in real time through the temperature detecting system monitoring the temperature field distribution in the furnace, avoiding the disadvantages of time delay and strong subjectivity in judging the operation of the apparatus by indirect means such as observing slag samples or detecting the components of syngas etc. It not only ensures the temperature in the furnace constantly being at high level, improves the gasification efficiency, and simplifies the operation, but also effectively prevents the damage of the fire-resistant material and the water-cooling wall caused by the abnormal operation of the apparatus.

The basic principle of the present invention is that: the dry powder of carbonaceous material and gasification agent (oxygen and steam, or oxygen-enriched air and steam) are reacted quickly and incompletely under high temperature and high pressure (temperature: 1200° C.-2000° C., pressure: 1 MPa-10 MPa) to generate a high temperature syngas (whose main ingredient is CO and $H_2$), a liquid slag and a flying ash (whose main ingredient is inorganic salt), which are subjected to quenching and deashing processes to obtain the crude syngas.

At the start of the apparatus operation, fuels for ignition (natural gas, diesel oil and the like) and gasification agent (oxygen or oxygen-enriched air) are sprayed into the gasification chamber II from a burner via the feeding inlet I and ignited. The ignition condition in gasification chamber II is observed by the flame-observing system. If no flame is detected, the inlet of the fuels and the gasification agent should be cut off in time, and nitrogen should be injected for replacement to prevent an explosive accident; if fire is detected, then the fuels for ignition and the gasification agent is continued to be sprayed into the gasification chamber II until both the pressure and the temperature in the gasification chamber II reach a certain value (pressure: 0.1-2.0 MPa, temperature: 300-1500° C.), and then the dry powder of carbonaceous material and the gasification agent are sprayed into proportionally. By this time, the ignition conditions in the gasification chamber II is still observed by the flame-observing system, and if the ignition is stable, the cut-off valve 9 of the observing system is shut off, and the pressure and the temperature in the gasification chamber II is continued to be increased.

When the pressure and the temperature of the apparatus are increased to the normal working state (temperature: 1200° C.-2000° C., pressure: 1 MPa-10 MPa), the furnace body 14 is the main pressure-containing member, and the water-cooling walls 3, 4, 5 are the main high temperature-resistant member. The protective gas, carbon dioxide is continuously flowed into the annular cavity between the upper furnace body 14 and the water-cooling walls 3, 4, 5 with a pressure slightly higher than that of gasification chamber II. The dry powder of carbonaceous material and the gasification agent are continuously sprayed into the gasification chamber II in proportion and reacted quickly and incompletely in a high temperature and high pressure environment to form a high temperature syngas, a liquid slag and a fine ash with the main ingredients of carbon monoxide and hydrogen. A part of the liquid slag directly flows towards the syngas cooling and purification chamber III accompanied with the syngas and fine ash, and the other part of the liquid slag is thrown to the water-cooling walls on which two layers of slag, i.e., a solid slag 26 layer and a liquid slag 25 layer are formed, in which the solid slag adheres to the fire-resistant material 16 of the water-cooling wall and the liquid slag contacted with the solid slag continuously flows into the syngas cooling and purification chamber III along the water-cooling wall via the outlet flange under the action of gravity. The temperatures of gasification chamber and the fire-resistant material are monitored by observing the values of the temperature detecting device 28 in the furnace and the temperature detecting device 27 for fire-resistant material, and the temperature of gasification chamber II are increased by adjusting the proportion of the dry powder of carbonaceous material and the gasification agent under the condition that all the detecting sites are not overheat.

The high-temperature syngas, liquid slag and flying ash flowing from the gasification chamber II into the syngas cooling and purification chamber III are rapidly cooled under the action of syngas quencher 2, in which the temperatures of the liquid slag and the flying ash both are reduced to temperatures lower than the melting point thereof and lose their viscosity, preventing from damaging the vertical pipe 22. The syngas, high-temperature solid slag and flying ash exchange heat by means of radiation and convection in the vertical pipe 22, thereby further decrease the temperature and increase the steam content in the syngas. The solid slag and fine ash flowing out from the vertical pipe 22 are mostly flowed into the slag pool under the action of gravity and inertia and captured by the slag water, and a part of the syngas inside the slag 25 pool flows out along the small pores of the gas distribution plate 24, and the other part of the syngas flows out from the bottom of gas distribution plate 24 upwardly. The syngas flowing out from the gas distribution plate 24 changes the flow direction under the action of the baffle 23, strengthening the capture effect of the slag water on ash and decreasing the ash in the crude syngas on one hand, and on the other hand, preventing the big bubbles from appearing, which is favorable to avoiding ash and water entrainment when increasing load. The crude syngas flows through layers of the defoaming plate 1 above the baffle 23 and changes the flow direction continuously, such that the kinetic energy for water and ash entrainment in the crude syngas is reduced, and the entrainment of water and ash by the syngas is decreased. The syngas flowing through the defoaming plate passes through the dewatering and deashing device 21, the water entrained in the syngas is further separated, and the entrainment of water and ash in the syngas is further decreased, which is especially capable of preventing the aggravated phenomenon of water and ash entrainment under the high loading conditions. The crude syngas processed after the above procedures is transported to a subsequent process from the syngas outlet 20. The slag in the slag pool is discharged from the slag outlet IV intermittently.

What is claimed is:

1. A gasification apparatus for solid fuel, comprising a furnace shell system, a gasification chamber system, and a syngas cooling and purifying system, the furnace shell system includes a furnace body of cylindrical structure and a cone-shaped disk, wherein a feeding inlet is on the top of the furnace body, a slag outlet is at the bottom of the furnace body and a syngas outlet is provided in the middle of the furnace body, the furnace body is divided into an upper furnace body and a lower furnace body by the cone-shaped disk, the upper furnace body comprises a gasification chamber which is located in the upper furnace body, and the lower furnace body comprises a syngas cooling and purifying chamber which is located in the lower furnace body, characterized in that: the gasification chamber has a water-cooling wall structure, a layer of fire-resistant material is evenly coated on the inner side of the water-cooling wall, and an annular cavity is between the water-cooling wall of gasification chamber and the furnace body; a purifying system including a syngas quencher, a vertical pipe, a gas distribution device, a defoaming device and a dewatering and deashing device is provided in the syngas-cooling and purification chamber, the syngas quencher is connected with the cone-shaped disk located at the bottom of the gasification chamber, the vertical pipe is connected with the syngas quencher by means of an outlet flange located in the bottom of the gasification chamber and is connected with the bottom of the gasification chamber, a trumpet-shaped gas distribution device is connected with the lower portion of the vertical pipe via a smooth transition, a baffle device is arranged above the gas distribution device, a defoaming device is arranged 100-800 mm above the baffle device, and a dewatering and deashing device is arranged 100-800 mm above the defoaming plate at the uppermost layer of the defoaming device.

2. The gasification apparatus for solid fuel as claimed in claim 1, wherein, it further comprises a flame observing system which is put into use only at the start of the device operation, the flame observing system bottom-up sequentially includes an observing tube, a cut-off valve, a transparent material layer and an industrial camera, an inlet flange for protective gas is connected with the side wall of the observing tube which is embedded in the fire-resistant material on the inner side of the inlet water-cooling wall through a furnace cover at the feeding inlet located at the top of the furnace body, an observing hole is preserved at the lower portion of the observing tube to communicate with the gasification chamber, the protective gas is flowed into the observing tube from the inlet flange for the protective gas, and the industrial camera observes the ignition conditions in the gasification chamber by means of the observing tube through transparent material layer and passes the obtained information back to a control room of the apparatus.

3. The gasification apparatus for solid fuel as claimed in claim 2 wherein, it further comprises a temperature monitoring system comprising several temperature detecting devices in the furnace arranged in circumferential direction at different heights of the body water-cooling wall, and the temperature detecting devices in the furnace protrude from the fire-resistant material of the water-cooling wall by 0-15 mm so as to monitor the temperature in the furnace in real-time.

4. The gasification apparatus for solid fuel as claimed in claim 2, wherein, the temperature monitoring system further comprises several temperature detecting devices for fire-resistant material arranged in circumferential direction at different heights, and the temperature detecting devices for fire-resistant material are 0-20 mm inwardly from the surface of the fire-resistant material of the water-cooling wall so as to monitor the temperature of the fire-resistant material in real-time.

5. The gasification apparatus for solid fuel as claimed in claim 2, wherein, a layer of 5-100 mm of fire-resistant material is evenly coated on the inner surface of the upper furnace body, and a layer of corrosion resisting stainless steel is overlaid on the inner surface of the lower furnace body.

6. The gasification apparatus for solid fuel as claimed in claim 2, wherein, the gasification chamber system includes inlet water-cooling wall, body water-cooling wall and outlet water-cooling wall which are all in the form of spiral coil; the inlet water-cooling wall is fixedly connected with the furnace cover by means of welding, the body water-cooling wall is fixed to the support plate in the upper furnace body, the support plate in the upper furnace body is composed of two or more pre-welding members which are distributed circumferentially and evenly; the outlet water-cooling wall is fixedly connected with the outlet flange of the gasification chamber by means of welding, and the outlet flange is fixedly connected with the cone-shaped disk.

7. The gasification apparatus for solid fuel as claimed in claim 2, wherein, both the inner side and outer side of the inlet water-cooling wall are coated with a high temperature fire-resistant material while only the inner sides of the body water-cooling wall and the outlet water-cooling wall are coated with the high temperature fire-resistant material, and said high temperature fire-resistant material is silicon carbide.

8. The gasification apparatus for solid fuel as claimed in claim 1 wherein, it further comprises a temperature monitoring system comprising several temperature detecting devices in the furnace arranged in circumferential direction at different heights of the body water-cooling wall, and the temperature detecting devices in the furnace protrude from the fire-resistant material of the water-cooling wall by 0-15 mm so as to monitor the temperature in the furnace in real-time.

9. The gasification apparatus for solid fuel as claimed in claim 8, wherein, the temperature monitoring system further comprises several temperature detecting devices for fire-resistant material arranged in circumferential direction at different heights, and the temperature detecting devices for fire-resistant material are 0-20 mm inwardly from the surface of the fire-resistant material of the water-cooling wall so as to monitor the temperature of the fire-resistant material in real-time.

10. The gasification apparatus for solid fuel as claimed in claim 8, wherein, a layer of 5-100 mm of fire-resistant material is evenly coated on the inner surface of the upper furnace body, and a layer of corrosion resisting stainless steel is overlaid on the inner surface of the lower furnace body.

11. The gasification apparatus for solid fuel as claimed in claim 8, wherein, the gasification chamber system includes inlet water-cooling wall, body water-cooling wall and outlet water-cooling wall which are all in the form of spiral coil; the inlet water-cooling wall is fixedly connected with the furnace cover by means of welding, the body water-cooling wall is fixed to the support plate in the upper furnace body, the support plate in the upper furnace body is composed of two or more pre-welding members which are distributed circumferentially and evenly; the outlet water-cooling wall is fixedly connected with the outlet flange of the gasification chamber by means of welding, and the outlet flange is fixedly connected with the cone-shaped disk.

12. The gasification apparatus for solid fuel as claimed in claim 1, wherein, the temperature monitoring system further comprises several temperature detecting devices for fire-resistant material arranged in circumferential direction at different heights, and the temperature detecting devices for fire-resistant material are 0-20 mm inwardly from the surface of the fire-resistant material of the water-cooling wall so as to monitor the temperature of the fire-resistant material in real-time.

13. The gasification apparatus for solid fuel as claimed in claim 12, wherein, a layer of 5-100 mm of fire-resistant material is evenly coated on the inner surface of the upper furnace body, and a layer of corrosion resisting stainless steel is overlaid on the inner surface of the lower furnace body.

14. The gasification apparatus for solid fuel as claimed in claim 1, wherein, a layer of 5-100 mm of fire-resistant material is evenly coated on the inner surface of the upper furnace body, and a layer of corrosion resisting stainless steel is overlaid on the inner surface of the lower furnace body.

15. The gasification apparatus for solid fuel as claimed in claim 1, wherein, the gasification chamber system includes inlet water-cooling wall, body water-cooling wall and outlet water-cooling wall which are all in the form of spiral coil; the inlet water-cooling wall is fixedly connected with the furnace cover by means of welding, the body water-cooling wall is fixed to the support plate in the upper furnace body, the support plate in the upper furnace body is composed of two or more pre-welding members which are distributed circumferentially and evenly; the outlet water-cooling wall is fixedly connected with the outlet flange of the gasification chamber by means of welding, and the outlet flange is fixedly connected with the cone-shaped disk.

16. The gasification apparatus for solid fuel as claimed in claim 1, wherein, both the inner side and outer side of the inlet water-cooling wall are coated with a high temperature fire-resistant material while only the inner sides of the body water-cooling wall and the outlet water-cooling wall are coated with the high temperature fire-resistant material, and said high temperature fire-resistant material is silicon carbide.

17. The gasification apparatus for solid fuel as claimed in claim 1, wherein, the structure of the gas distribution device is in the form of annular plate with pores and/or a number of circular girdle with sawteeth, and a plurality of opening pores with a pore size of 10-150 mm are present on the gas distribution device.

18. The gasification apparatus for solid fuel as claimed in claim 17, wherein, a plurality of opening pores with a pore size of 10-150 mm are present on the baffle of the baffle device, the opening pores being staggered with the opening pores of the foregoing gas distribution device.

19. The gasification apparatus for solid fuel as claimed in claim 1, wherein, the defoaming device includes 2-6 layers of defoaming plates, each layer of the defoaming plates is composed of multiple annular plates which are fixed onto the support member for defoaming plate of the lower furnace body, opening pores with a pore size of 10-150 mm are regularly arranged on the defoaming plates, and the small pores between adjacent two layers are staggered.

* * * * *